US006299556B1

(12) United States Patent
Redden

(10) Patent No.: US 6,299,556 B1
(45) Date of Patent: Oct. 9, 2001

(54) GOAL FOR BALL GAMES

(76) Inventor: Paul Redden, Hole Farm, Portsmouth Road, Thursley Godalming (GB), GU8 6NN ( * ) Notice: Subject to any disclaimer, the term of this patent is extended or adjusted under 35 U.S.C. 154(b) by 0 days.

(21) Appl. No.: 09/077,447

(22) PCT Filed: Sep. 30, 1997

(86) PCT No.: PCT/GB97/02628

§ 371 Date: May 29, 1998

§ 102(e) Date: May 29, 1998

(87) PCT Pub. No.: WO98/14246

PCT Pub. Date: Apr. 9, 1998

(30) Foreign Application Priority Data

Oct. 1, 1996 (GB) ..... 9620462
Aug. 11, 1997 (GB) ..... 9717005

(51) Int. Cl.[7] ..... A63B 63/08
(52) U.S. Cl. ..... 473/483; 473/476
(58) Field of Search ..... 473/422, 447, 473/479, 481, 483, 485, 459, 476

(56) References Cited

U.S. PATENT DOCUMENTS

| | | | | |
|---|---|---|---|---|
| 3,017,183 | | 1/1962 | Chalcroft . | |
| 3,181,849 | * | 5/1965 | Mitchell | 473/485 X |
| 3,467,388 | | 9/1969 | Weiler . | |
| 3,544,110 | * | 12/1970 | Dickinson | 473/483 |
| 3,825,257 | | 7/1974 | Palmer . | |
| 3,881,724 | | 5/1975 | Beveridge . | |
| 4,202,543 | | 5/1980 | Collins . | |
| 4,226,416 | | 10/1980 | Callanan . | |
| 4,266,764 | | 5/1981 | Collins . | |
| 4,268,029 | | 5/1981 | Collins . | |
| 4,286,779 | | 9/1981 | Collins . | |
| 5,037,093 | * | 8/1991 | Roark, Jr. | 473/483 |
| 5,330,199 | | 7/1994 | Vand | 273/400 |
| 5,338,023 | | 8/1994 | Stovall . | |
| 5,558,323 | | 9/1996 | LoFaso, Sr. . | |

* cited by examiner

*Primary Examiner*—Sam Rimell
(74) *Attorney, Agent, or Firm*—Christopher John Rudy

(57) ABSTRACT

Sports training apparatus has a substantially vertical base and a hoop-carrying member adapted to be attached to the base in a pre-selected position. The hoop-carrying member has attached at least one mounting bracket and hoop assembly of a mounting bracket supporting a hoop. The base can have a backboard attached also, with the backboard including at least one ball-support bracket adapted to receive and/or retain a ball, and the backboard is spaced from the base in a direction opposite the hoop. The hoop-carrying member can be adapted to be attached to the base in a plurality of pre-selected vertical positions, and the top portion of the base can have an angular portion carrying at least one hoop, in which the angular portion carries a hoop adapted to be located in a plurality of positions along its path.

16 Claims, 6 Drawing Sheets

FIG. 3
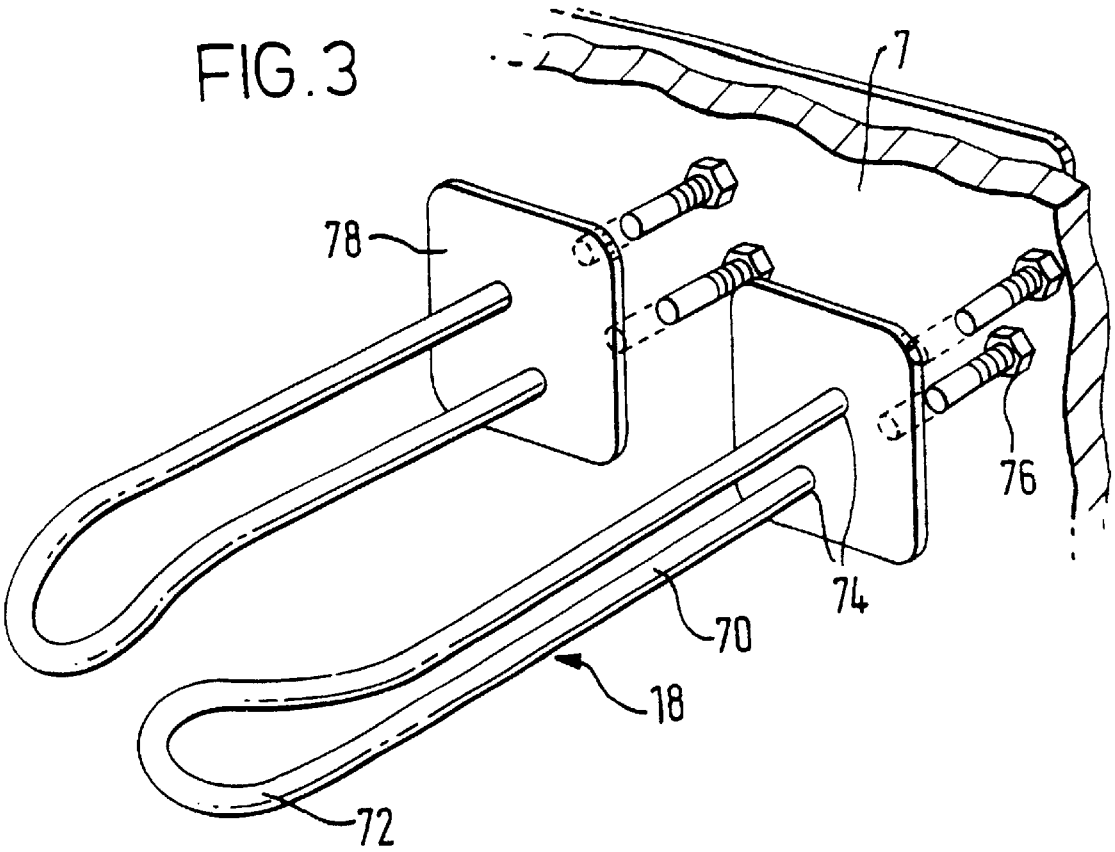
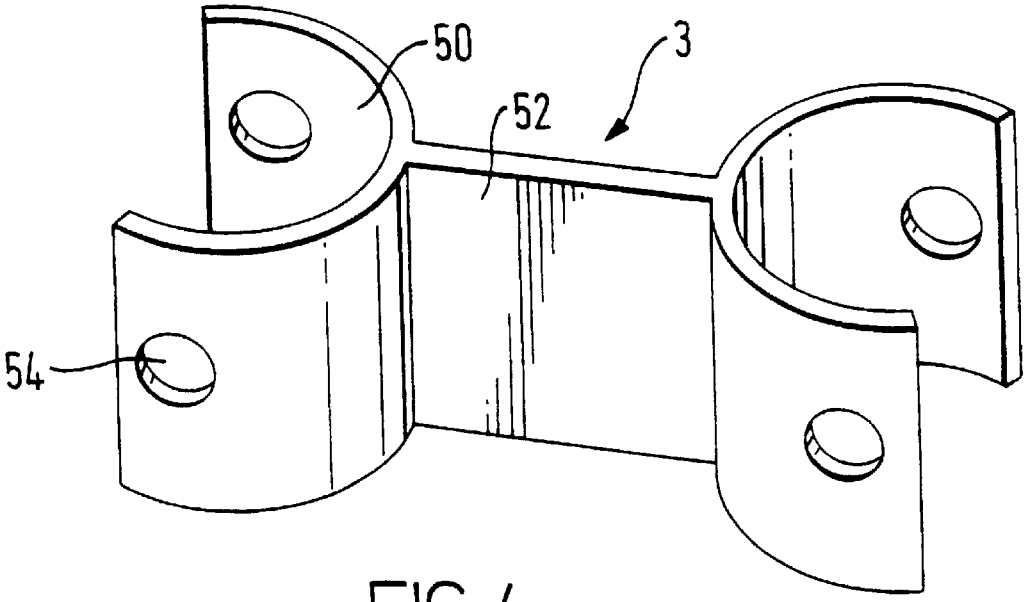
FIG. 4

GOAL FOR BALL GAMES

This invention relates to sports training apparatus, and in particular to apparatus designed to improve throwing and catching techniques in ball games, such as rugby, netball, basketball, American football, and the like.

For example, in the game of rugby, the technique of throwing and catching are most obviously demonstrated in the 'line out', when a player known as the 'hooker' throws the ball down a line of players in the hope that it will be caught by another player known as the 'lock'. It is an object of the present invention to provide training apparatus which can be used to improve the hooker's throwing skills, and the jumping and catching skills of the lock. These skills are also an essential part of many other ball games, such as those mentioned above.

In accordance with a first aspect of the present invention, there is provided sports training apparatus, comprising a substantially vertical base, a hoop and a bracket for receiving a ball, said hoop and said bracket being mounted at a position above ground level on said base.

In accordance with a second aspect of the present invention, there is provided sports training apparatus comprising a base and a hoop mounted on said base at a position above ground level, said hoop being orientable relative to said base.

In accordance with a third aspect of the present invention, there is provided sports training apparatus comprising a base and a bracket for receiving a ball, said bracket being mounted on said base at a position above ground level.

The sports training apparatus of the present invention preferably comprises at least two hoops and at least two brackets.

In one embodiment of the present invention the base may comprise a substantially vertical post comprising three sections an elongate generally vertical pole, a sleeve surrounding at least a portion of the pole and an end section connected to the upper end of the pole. The upper end of the pole is preferably bent to form an angular portion. The sleeve is preferably free to move up and down along the pole and is preferably provided with handles for moving the sleeve up and down along the pole.

A holding pin may be provided, the pole having at least one aperture into which the holding pin can be inserted to fix the sleeve relative to the pole. In a preferred embodiment, the pole is provided with a plurality of apertures into which the holding pin can be inserted so as to fix the sleeve at any one of a plurality of different heights relative to the pole.

The hoop and bracket are preferably mounted at the outer end of respective horizontal supports extending from diametrically opposing positions on the sleeve. Similarly, another hoop and bracket may be mounted at the outer end of a respective horizontal support extending from diametrically opposing positions at or adjacent the end of the end section. The position of the hoop and bracket relative to the end section may be adjustable, and the bracket or brackets are preferably mounted on an angled backboard.

The apparatus preferably comprises a ground support which can be fixed in or on the ground and comprises a generally tubular member into which the base of the apparatus is inserted. All or part of the base may be covered with a padded material.

In another embodiment of the present invention, the base comprises two substantially vertical posts which are parallel to and spaced apart from each other. The vertical posts are held together as a single unit by means of one or more strengthening brackets. The strengthening brackets may comprise two generally C-shaped sections which are joined together by a central flat section.

The apparatus can comprise tubular ground support into which the vertical posts are inserted, the ground supports being fixed in or on the ground in use. The vertical posts may be attached to the ground supports by means of a bolt which passes through corresponding apertures in the posts and in the ground supports. In a preferred embodiment, the vertical posts comprise a plurality of apertures along at least a portion of their length such that the height of the apparatus relative to the ground can be adjusted. The vertical post may also comprise a plurality of apertures around at least a portion of its circumference so that the posts can be twisted in the ground supports and fixed in any desired position in use. Similarly, the vertical posts may be provided with a plurality of apertures around at least a portion of their circumference in the position at which the strengthening brackets are located.

In both embodiments of the present invention, the or each ground support is preferably provided with a closure at ground level for closing off the top of the or each ground support when the base of the apparatus is removed therefrom. Furthermore, the hoop can be provided with a removable net.

Referring back to the second embodiment of the present invention one hoop is preferably mounted at or adjacent the upper end of one of the vertical posts, the upper end preferably being bent to form an angular portion. The vertical post may comprise means for adjusting the position of the hoop relative to the vertical post.

The ball-receiving bracket is preferably mounted at the upper end of the other vertical post. A backboard may be mounted at the upper end of the other vertical post and the ball-receiving bracket is supported on the backboard. Again, the upper end of the other vertical post is preferably bent so as to form an angular portion. Similarly, the vertical post may again comprise means for adjusting the position of the bracket relative to the vertical post.

Two or more ball-receiving brackets may be provided on one backboard

Embodiments of the present invention will now be described by way of examples only and with reference to the accompanying drawings, in which:

FIG. 3 is an expanded view of the brackets used in the apparatus of FIG. 1;

FIG. 4 is an expanded view of the ground support used in the apparatus of FIG. 1;

Figure 1:
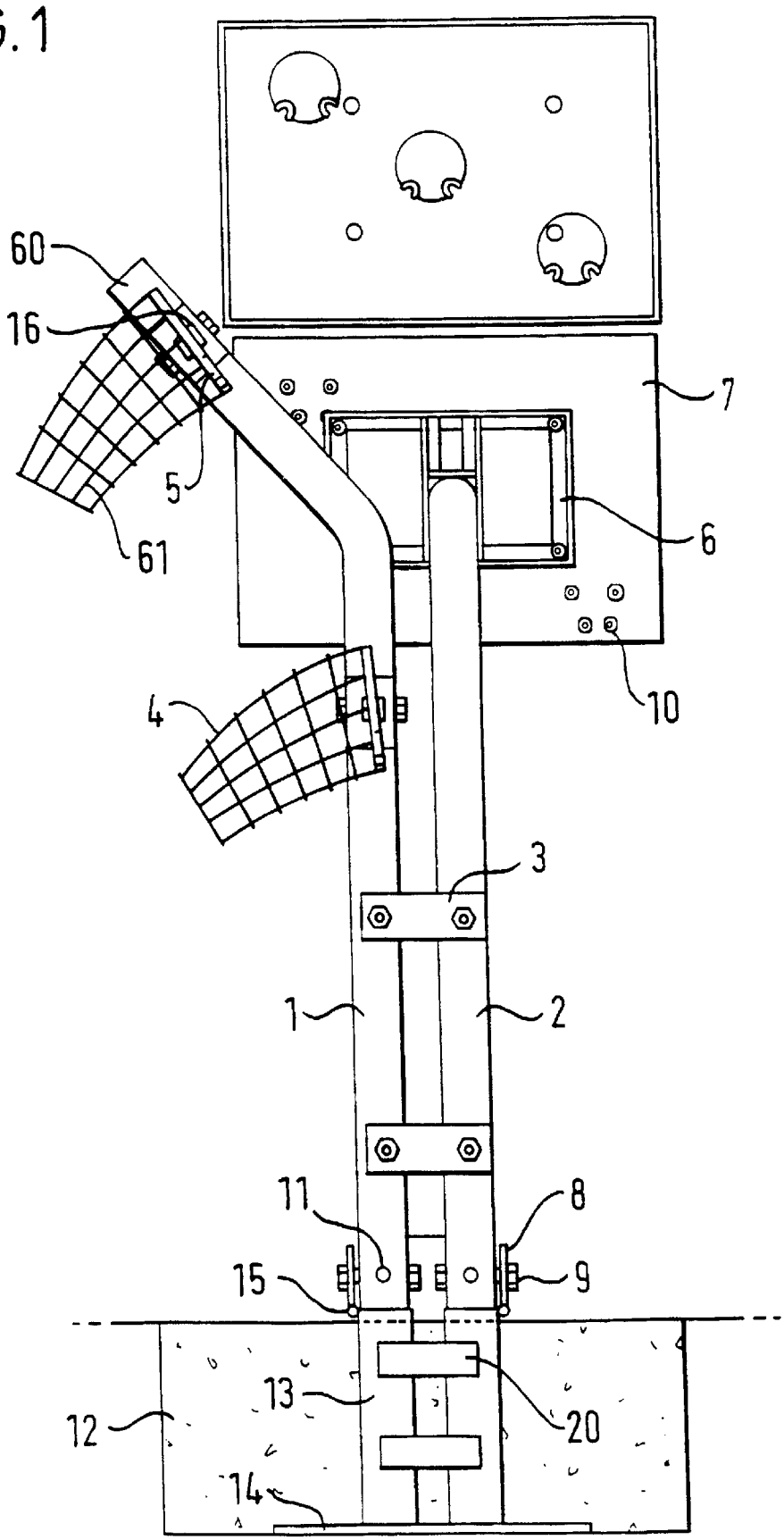
FIG. 1 is a front view of sports training apparatus according to a first embodiment of the present invention.
Figure 2:
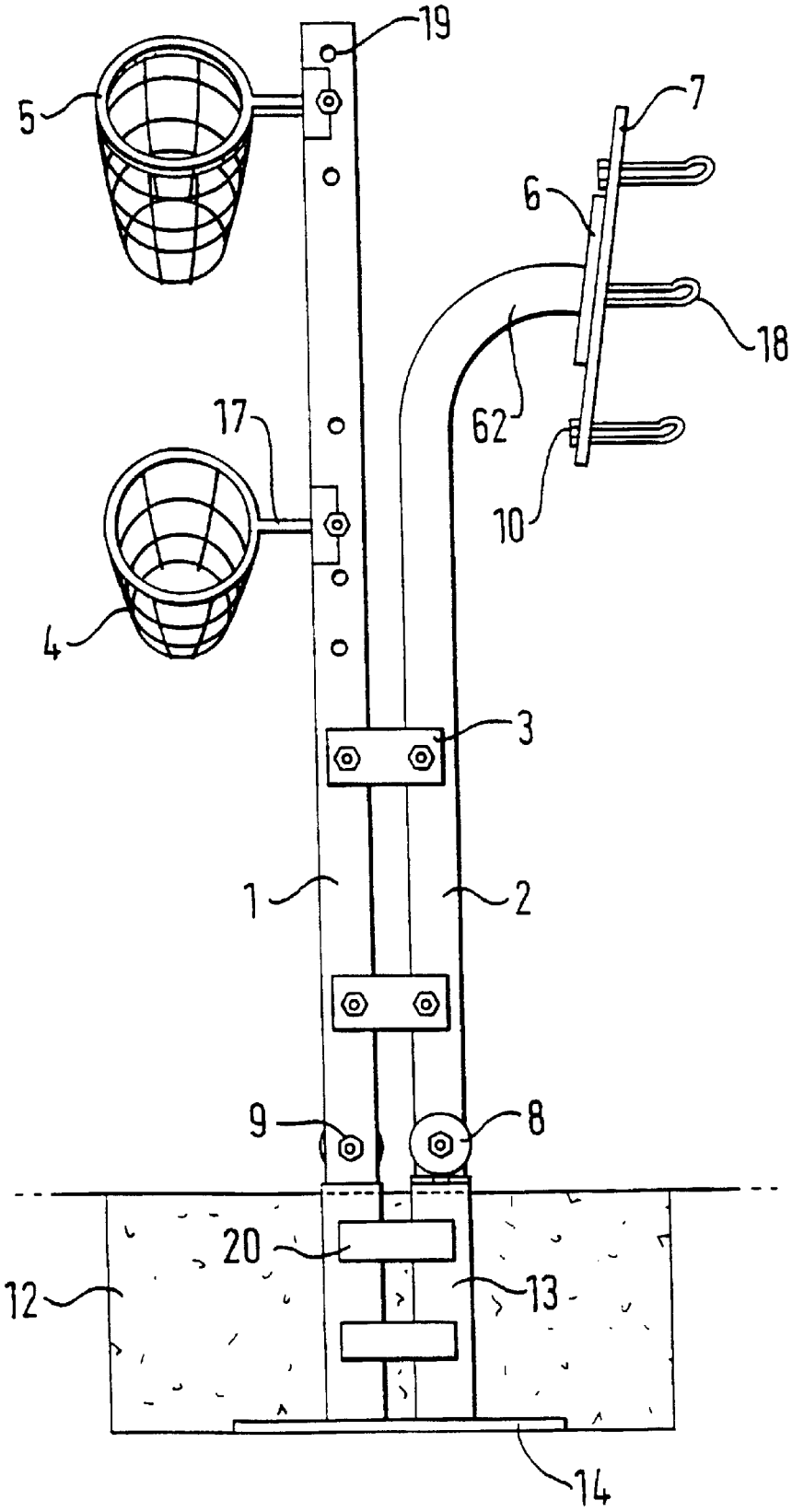
FIG. 2 is a side view of the apparatus of FIG. 1.

Referring to FIGS. 1 and 2 of the drawings, sports training apparatus according to a first embodiment of the present invention comprises two substantially vertical posts 1, 2. The posts are held together to form a single unit by means of one or more strengthening brackets 3. The strengthening brackets 3 are bolted to the posts 1, 2 at various positions along their length. The number of strengthening brackets necessary will depend upon the length of the posts. When the apparatus is assembled, the posts are held in a position spaced apart from and parallel to each other, as shown.

Referring to FIG. 4 of the drawings, the strengthening brackets consist of two generally C-shaped portions 50 which are joined together by a central web 52 such that the openings of the C-shaped portions face outwards, as shown. In use, each of the posts 1, 2 is inserted through the centre of one of the C-shaped sections and the strengthening bracket is moved along the posts to the required position. Bolt holes 54 are provided in each of the C-shaped sections for receiving a bolt (not shown) to fix the strengthening bracket to each of the two posts at the required position. The strengthening brackets 3 are designed to avoid trapping limbs and fingers.

Referring back to FIGS. 1 and 2 of the drawings, the lower ends of the posts 1, 2 are held in tubular supports 13. During assembly, each post 1, 2 is slid into one of the tubular supports 13, and braces 20 are used to ensure that the position of the posts remains fixed. The tubular supports 13 are fixed to a base plate 14 which can be fixed on or in the ground at any desired location.

The posts 1, 2 are fixed in the tubular supports by means of a bolt 9 which passes through corresponding apertures in the post and the tubular support. The posts may be provided with a plurality of apertures (not shown) along a portion of its length such that the height of the apparatus can be altered according to requirements. In addition, the posts 1, 2 can be rotated within the tubular supports 13 and a plurality of apertures (not shown) may be provided around a portion of the circumference of the posts such that they can be fixed in any desired position.

The apparatus can be removed for storage by simply drawing the posts 1, 2 out of the tubular supports 13. First, the bolts in the strengthening brackets 3 must be loosened or removed and the strengthening brackets are then moved down to the base of the posts. Then the posts are drawn out of the tubular supports 13 and removed from the strengthening brackets 3 at the base of the posts. If the posts are required to be rotated, the bolts in the strengthening brackets 3 are removed, the post rotated and the bolts can then be replaced. A plurality of apertures (not shown) may be provided for this purpose around at least a portion of the circumference of each of the posts in the location at which the strengthening brackets 3 are to be fixed.

Each of the tubular supports 13 is provided with a closure 8 at ground level. When the posts are removed from the tubular supports, the opening at the top of the tubular supports can be closed off in order to avoid foot and ankle injuries.

The upper end of one of the posts 1 is bent so as to provide an angular portion 60. A hoop 5 is mounted at a position adjacent the end of the angular portion 60 by means of a mounting bracket 16. A plurality of apertures (not shown) may be provided in the angular portion 60 so as to enable the height and orientation of the hoop 5 to be altered according to requirements. A removable net 61 is provided around the circumference of the hoop 5 so as to form a basket through which a ball can be thrown.

The upper end of the other post 2 is also bent to form an angular portion 62 (as shown in FIG. 2). A frame 6 is welded to the end of the angular portion 62, and a backboard 7 is mounted to the frame 6. Thus, a stable, angled backboard is provided on which one or more ball support brackets 18 can be mounted.

Referring to FIG. 3 of the drawings, the ball support brackets 18 each comprise two parallel arms 70 which are spaced apart from each other so as to provide a gap between them for receiving a ball (not shown). The arms are designed so that they can be used to support a ball in a horizontal or vertical position, as required. The outer ends 72 of the arms are curved inwardly towards each other, and the opposite ends 74 of the arms are mounted to a support plate 78 Referring back to FIG. 2, the ball support brackets are mounted to the backboard 7 via the support plate 78 by means of bolts 76 which pass through apertures (not shown) in the backboard 7 and the support plate 78. The arms 70 are formed of solid bars or rods which are bent to form generally U-shaped elements. The bolts 76 may pass through the support plate 78 into the opening at the end of the tubular members, as shown. In the example shown, three brackets 18 are provided, the brackets being staggered diagonally across the backboard 7.

The posts 1, 2 may be angled to differing degrees according to requirements. The use of two posts, one for supporting the hoop 5 and one for supporting the brackets 18, increases the safety and versatility of the apparatus. Each post may be angled to differing degrees, and in plan the bends may be set to any angle. In the example shown, the post 1 which supports the hoop 5 is bent so as to facilitate a jumping catch. The post 2 which supports the brackets 18 is bent so as to ensure that the backboard is a safe distance from the other post 1 to avoid collision of players with the post 1.

Figure 5:
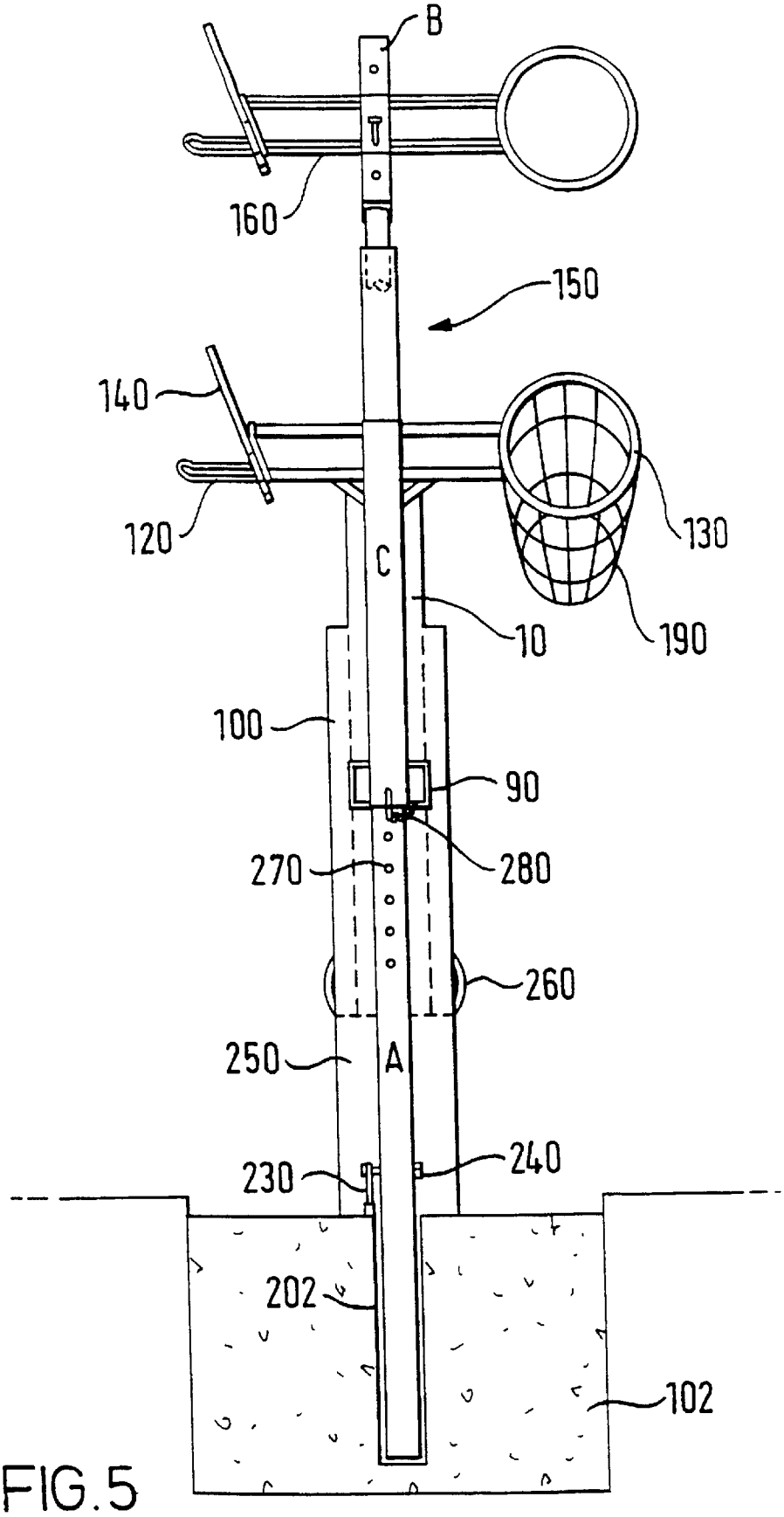
FIG. 5 is a front view of sports training apparatus according to a second embodiment of the present invention.
Figure 6:
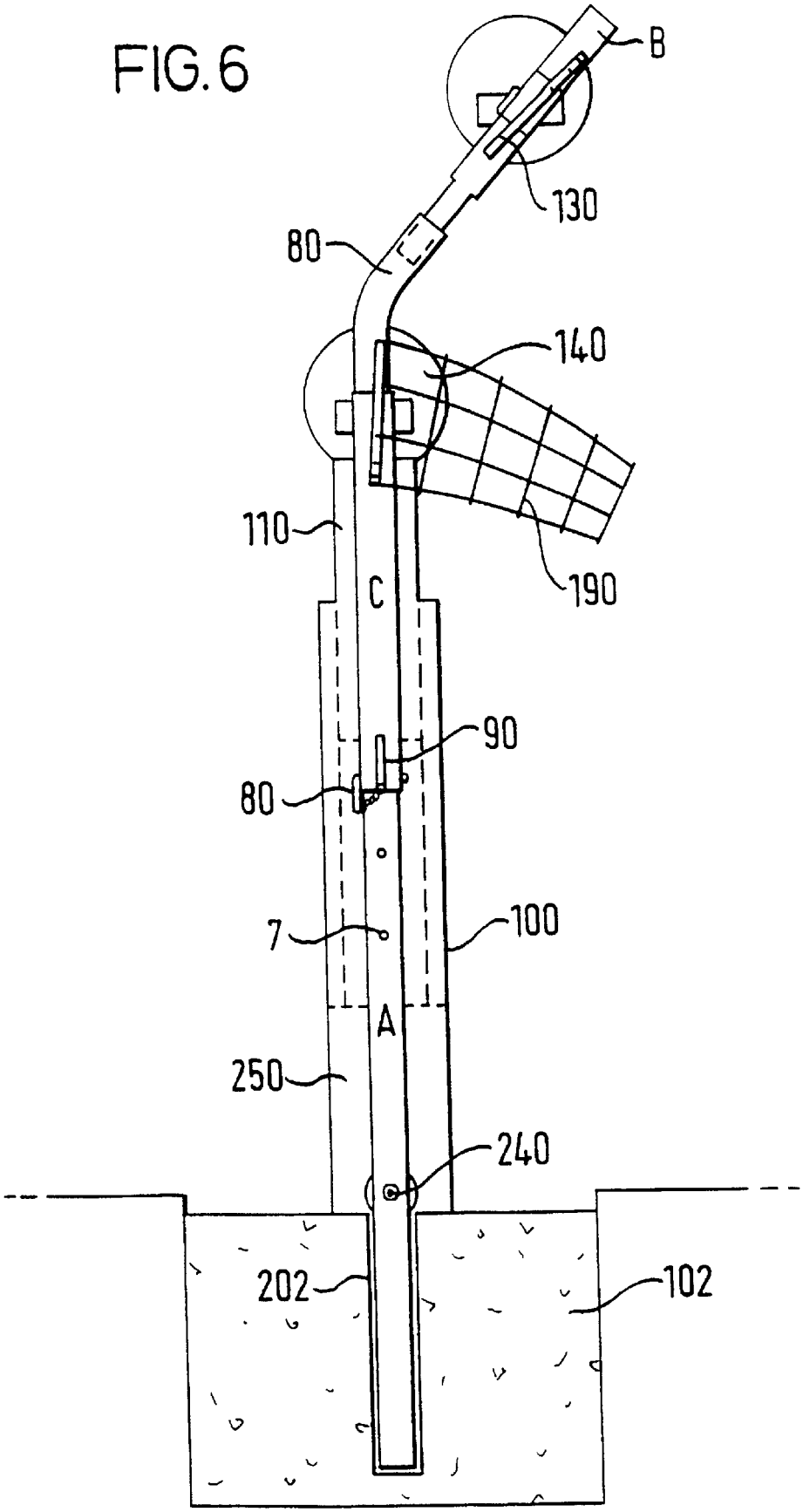
FIG. 6 is a side view of the apparatus of FIG. 5.

Referring to FIGS. 5 and 6 of the drawings, a second embodiment of the training apparatus of the present invention is similar in many respects to the first embodiment. However, in this case, the apparatus comprises only a single post 150.

The post 150 is comprised of three sections A, B and C. Section A comprises an elongate, generally vertical tubular pole, the upper end of which is bent to form an angular portion 80 (as shown in FIG. 6). The pole is provided with a plurality of apertures 270, as shown.

Figure 8:
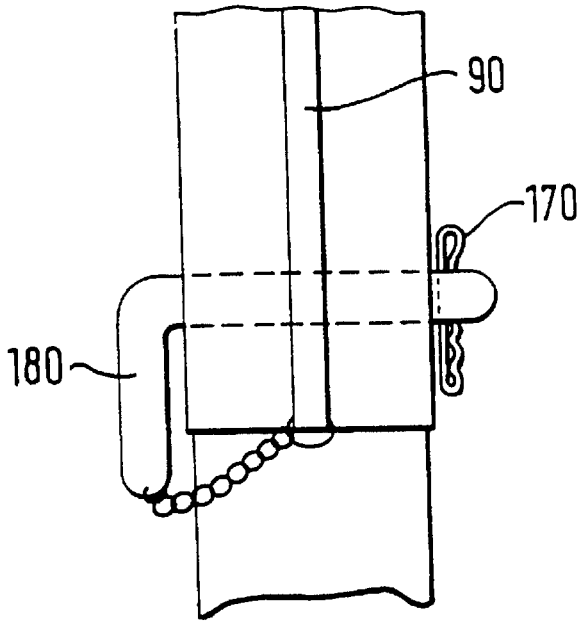
FIG. 8 is an expanded view of the holding pin arrangement used in the apparatus of FIG. 5.

Section C is a sleeve which surrounds a portion of the length of section A, and freely slides up and down section A. The apertures 270 in section A enable section C to be positioned at one of a plurality of different heights according to requirements. At the base of section C are situated two handles 90 which provide the means by which section C can be moved up and down. Referring to FIG. 8 of the drawings, section C is lifted to the required height, and a holding pin 180 is provided which is inserted into one of the apertures 270 in section A, at the required height. The base of section C is provided with a groove (not shown) which is lowered onto the pin. R-clips 170 are provided to hold the pin 180 in place. The pin 180 and the R-clips 170 are chained to the handle 90 at the base of section C.

A mounting bracket is provided which comprises two pairs of horizontal metal bars 160 which extend outwards from respective diametrically opposite sides of section C, at a position at or adjacent the upper end of section C, as shown. A hoop 130 is mounted at the outer end of one of the pairs of metal bars 160. The hoop may be provided with a removable net 190 so as to form a basket through which a ball can be thrown.

Figure 7:
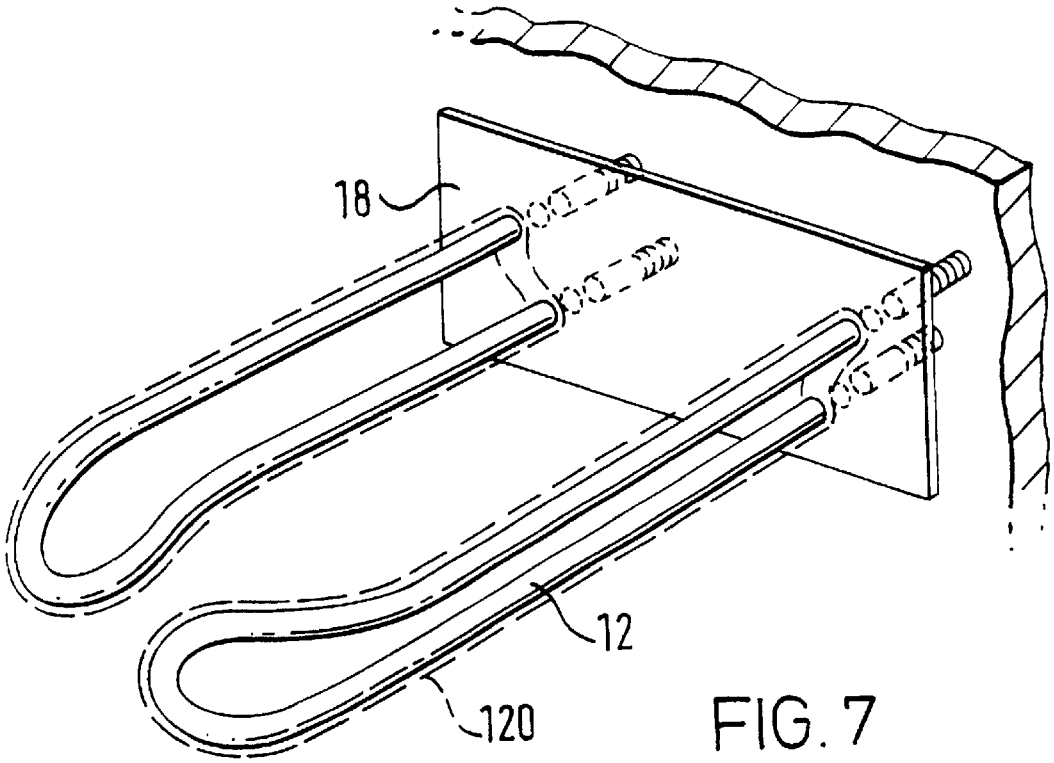
FIG. 7 is an expanded view of the brackets used in the apparatus of FIG. 5.

An angled backboard 140 is mounted to the outer ends of the other pair of metal bars 160. A padded ball support bracket 120 extends substantially horizontally from the backboard 140. Referring to FIG. 7 of the drawings, the ball support bracket 120 is substantially same at that described with reference to the first embodiment of the present invention. The angled backboard 140 is positioned to facilitate unassisted jumping, and can be raised or lowered by sliding section C up or down section A as described above. The number of different heights to which the hoop and angled backboard can be adjusted is defined only by the number of apertures provided in section A. Furthermore, the mounting bracket 160 can be swung around at least a portion of the circumference of section C.

Referring back to FIGS. 5 and 6, a tubular ground support 202 is buried in the ground 102. The apparatus is fixed to the ground by inserting the lower end of the post 150 into the tubular ground support 202. A bolt 240 is provided to secure the post 150 to the ground support 202. The apparatus is thereby held securely in place, while allowing it to be easily removed as required. Furthermore, the post 150 can be rotated within the ground support 202 so as to avoid surface wear. In order to rotate or remove the post 150 it is necessary to remove the bolt 240.

The ground support 202 is again provided with a closure 230 at or below ground level. When the post 150 is removed, the closure is used to close off the end of the tubular ground support 202 so as to prevent foot and ankle injuries. Section A provides suitable means by which it may be fixed to the closure 230 on top of the ground support 202.

Section B is an elongate portion which interlocks with the upper end of section C and provides a closure for sections A+C. A further mounting bracket is provided which comprises two pairs of horizontal metal bars 160 which extend outwardly from diametrically opposite sides of section B. Another hoop 130 is mounted at the outer end of one of the pair of bars, and another angled backboard 140 having a ball support bracket 120 is mounted at the outer end of the other pair of bars. This second angled backboard facilitates assisted jumping. The degree of bend in the post 150 chosen to ensure that the backboard set at the height for assisted jumping does not interfere with the backboard set for unassisted jumping. The mounting bracket can be moved along section B so as to adjust the height of the hoop and backboard according to requirements.

Padding covers the post 150 from the base to the top of section C, and is provided in three parts. The first part 250 provides suitable means by which it is attached to and therefore completely covers the circular base of section A. The second part 100 provides suitable means by which it is attached to and therefore completely covers section C. The third part 110 of padding covers the gap between top and bottom sections, and has attached at a convenient position suitable means by which it can be pushed up or pulled down to reveal the handles 90 which facilitate the movement of section C.

In the light of this disclosure, modifications of the described embodiments, as well as other embodiments, all within the scope of the present invention as defined by the appended claims, will now be apparent to persons skilled in the art.

What is claimed is:

1. Sports training apparatus comprising a substantially vertical base having top and bottom portions, a hoop-carrying member adapted to be attached to the base in a plurality of pre-selected vertical positions, the hoop-carrying member having attached thereto at least one mounting bracket and hoop assembly of a mounting bracket supporting a hoop, in which the hoop-carrying member has a tubular structure and encloses the base to be slideably movable vertically along the base and adapted to be retained in a plurality of pre-selected positions, and in which the base has a backboard attached also, and in which the backboard includes at least one ball-support bracket adapted to receive and/or retain a ball, and the backboard is spaced from the base in a direction opposite the hoop.

2. Sports training apparatus according to claim 1, in which the at least one ball-support bracket is padded.

3. Sports training apparatus according to claim 1, in which the top portion of the base carries an angular portion carrying at least one hoop.

4. Sports training apparatus according to claim 3, in which the at least one ball-support bracket is padded.

5. Sports training apparatus according to claim 1, which includes a ground tube, adapted to be located securely in a ground plane and having an opening for insertion of the lower portion of the base, and locking means to retain the base within the ground tube.

6. Sports training apparatus according to claim 3, which includes a ground tube, adapted to be located securely in a ground plane and having an opening for insertion of the lower portion of the base, and locking means to retain the base within the ground tube.

7. Sports training apparatus according to claim 2, in which the base is provided with adjustable padding from the lower portion of the base to the height of the lone hoop if only one hoop is present and the lowest hoop if more than one hoop is present.

8. Sports training apparatus according to claim 4, in which the base is provided with adjustable padding from the lower portion of the base to the height of the lone hoop if only one hoop is present and the lowest hoop if more than one hoop is present.

9. Sports training apparatus according to claim 7, in which the hoop of each at least one mounting bracket and hoop assembly carries a removable tubular net.

10. Sports training apparatus according to claim 8, in which the hoop of each at least one mounting bracket and hoop assembly carries a removable tubular net.

11. Sports training apparatus comprising a substantially vertical base, a hoop-carrying member adapted to be attached to the base in a pre-selected position, the hoop-carrying member having attached thereto at least one mounting bracket and hoop assembly of a mounting bracket supporting a hoop, in which the base has a backboard attached also, and in which the backboard includes at least one ball-support bracket adapted to receive and/or retain a ball, and the backboard is spaced from the base in a direction opposite the hoop.

12. Sports training apparatus according to claim 11, in which at least one of the at least one hoop assembly has a hoop mounted substantially not parallel with the plane of the ground.

13. Sports training apparatus according to claim 12, in which the at least one ball support bracket is padded.

14. Sports training apparatus according to claim 13, in which the hoop of each at least one mounting bracket and hoop assembly carries a removable tubular net.

15. Sports training apparatus according to claim 11, in which there are a plurality of hoops.

16. Sports training apparatus according to claim 12, in which there are a plurality of hoops.

* * * * *